United States Patent [19]

Martinelli

[11] 4,052,208

[45] Oct. 4, 1977

[54] IMAGE RECORDING MEDIUM EMPLOYING PHOTOCONDUCTIVE GRANULES AND A HEAT DISINTEGRABLE LAYER

[76] Inventor: Michael A. Martinelli, 58 Wedgemere Ave., Winchester, Mass. 01890

[21] Appl. No.: 584,108

[22] Filed: June 5, 1975

Related U.S. Application Data

[63] Continuation-in-part of Ser. No. 357,107, May 4, 1973, abandoned.

[51] Int. Cl.[2] ..... G03G 5/00; G03G 5/12; G03G 17/00

[52] U.S. Cl. ..... 96/1.5 R; 96/1 R; 96/1 E; 96/1.2; 96/1.3; 96/1.8; 250/316; 346/76 R; 355/3 R; 355/4; 346/160; 346/162; 346/163

[58] Field of Search ..... 96/1.5, 1.8, 1 E, 1.2; 346/76 R, 74 S, 74 SB, 74 P; 250/316

[56] References Cited

U.S. PATENT DOCUMENTS

| | | | |
|---|---|---|---|
| 2,798,959 | 7/1957 | Moncrieff-Yeates | 96/1 E |
| 2,836,479 | 5/1958 | Traub et al. | 346/76 R X |
| 2,858,181 | 10/1958 | Ortlieb | 346/76 R X |
| 2,858,633 | 11/1958 | Kane | 346/76 R X |
| 2,912,592 | 11/1959 | Mayer | 96/1.5 |
| 2,940,847 | 6/1960 | Kaprelian | 96/1.2 |
| 3,000,735 | 9/1961 | Gunning et al. | 96/1.5 |
| 3,031,250 | 4/1962 | Laeufer et al. | 346/76 R |
| 3,199,086 | 8/1965 | Kallmann et al. | 96/1.5 |
| 3,316,088 | 4/1967 | Schaffert | 96/1.5 |
| 3,319,251 | 5/1967 | Reis | 346/76 R X |
| 3,386,551 | 6/1968 | D'Onofria | 346/76 R X |
| 3,419,886 | 12/1968 | Ortlieb | 346/76 R X |
| 3,429,991 | 2/1969 | Ortlieb | 346/76 R X |
| 3,453,436 | 7/1969 | Nail | 96/1.5 UX |
| 3,457,070 | 7/1969 | Watanabe et al. | 96/1.5 X |
| 3,510,419 | 5/1970 | Carreira et al. | 96/1 PE |
| 3,512,968 | 5/1970 | Tulagin | 96/1 M |
| 3,515,880 | 6/1970 | Letter | 96/1.5 X |
| 3,536,483 | 10/1970 | Watanabe et al. | 96/1 R |
| 3,600,173 | 8/1971 | Levinos | 96/1.5 X |
| 3,615,420 | 10/1971 | Deutsch | 96/1.8 |
| 3,625,682 | 12/1971 | Oster et al. | 96/1.5 X |
| 3,625,688 | 12/1971 | Te Velde | 96/1.5 X |
| 3,649,116 | 3/1972 | Hall | 96/1.5 X |
| 3,652,270 | 3/1972 | Yamashita | 96/1.5 |
| 3,653,885 | 4/1972 | Levy et al. | 96/1 PS |
| 3,673,594 | 6/1972 | Kazan | 346/74 R |
| 3,717,459 | 2/1973 | McClure | 96/1.5 X |
| 3,717,460 | 2/1973 | Duck et al. | 96/1.5 X |
| 3,723,113 | 3/1973 | Goffe | 96/1 PS |
| 3,752,667 | 8/1973 | D'Onofria | 346/74 R |
| 3,772,011 | 11/1973 | Guevara et al. | 96/1.5 X |
| 3,798,030 | 3/1974 | Gundlach | 96/1 PS |
| 3,838,431 | 9/1974 | Germer | 346/76 R |
| 3,854,943 | 12/1974 | Luebbe | 96/1.5 |

OTHER PUBLICATIONS

Vargo et al, "Electrode Erosion in Spark Discharges," *J. App. Physics,* vol. 33, No. 9, 1962, pp. 2911-2912.

Cassiers, "Electrothermography-A New Electrostatic Printing Technique," *Photo. Science & Engineering,* vol. 4, No. 4, July-Aug. 1960, pp. 199-202.

Robillard, "New Approaches in Photography," *Photo. Science & Engineering,* vol. 8, No. 1, Jan.-Feb. 1964, pp. 18-34.

Anschel et al, "Electrographic Image Forming Materials," *IBM Tech. Disclosure Bulletin,* vol. 15, No. 2, July 1972, p. 605.

*Primary Examiner*—David Klein
*Assistant Examiner*—John R. Miller
*Attorney, Agent, or Firm*—Martin M. Santa

[57] ABSTRACT

An image recording medium for recording incident radiation to provide a positive transparency is constructed of two electrically conductive composite layers containing photoconductive material between them. One of the conductive layers is opaque and the other is transparent to the incident radiation. A voltage, sufficient to cause holes to be produced in the opaque conductive layer in response to the incident radiation, is applied between the conductive layers. Various systems for controlling the recording process are described.

32 Claims, 14 Drawing Figures

IMAGE RECORDING MEDIUM EMPLOYING PHOTOCONDUCTIVE GRANULES AND A HEAT DISINTEGRABLE LAYER

This application is a continuation-in-part of copending patent application Ser. No. 357,107, filed May 4, 1973, now abandoned.

BACKGROUND OF THE INVENTION

The invention relates to a radiation recording medium which is capable of permanently recording a radiation pattern or image impressed on its surface. This recording is in the form of a positive transparency.

Previous efforts to provide a permanent recording of incident radiation using radiation responsive conductive materials have not been able to provide a permanent record that is immediately available. For example, the recording medium of U.S. Pat. No. 3,565,613 of Tamai et al. provided a latent image stored in a photoconductive material. This stored image was made available only after subsequent electrolytic processing of the recording medium. The recording medium of U.S. Pat. No. 3,306,160 of Dinhobel et al. provided a stored image in the form of electric fields stored within the photoconductive recording medium. These stored fields and attendant mechanical distortion were rendered visible by the use of subsidiary viewing equipment. Neither of these recording techniques provided a permanent recorded image available immediately after the recording process as in the present invention.

It is therefore an object of this invention to provide a radiation image recording medium in which a permanent recording is available for viewing by conventional means without further processing.

SUMARY OF THE INVENTION

The recording media of this invention have the common features of being a layered structure comprising an opaque electrically conductive layer, a composite layer containing photoconductive material applied thereto and a radiation-transparent electrically conductive layer thereon. Some forms of the recording media, the two element forms, require mechanical pressure to effect electrical contact between the transparent layer and the composite layer containing photoconductive material. Other forms of recording media have the transparent layer permanently affixed to the photoconductive layer and do not require pressure.

In order to record illumination or radiation incident upon the transparent layer of the medium, it is necessary to apply a voltage between the two electrode layers sufficient to cause the erosion of holes in the opaque layer which correspond to the illumination.

The invention also consists of several forms of structure to control the recording process. Some of these structures are adapted to provide the appropriate mechanical pressure and voltage for those recording media that are of the two element form. Other structures are adapted to control the recording process for the one element forms.

FIG.. 3 is a cross-sectional view of another embodiment of the recording medium.

Figure 4:
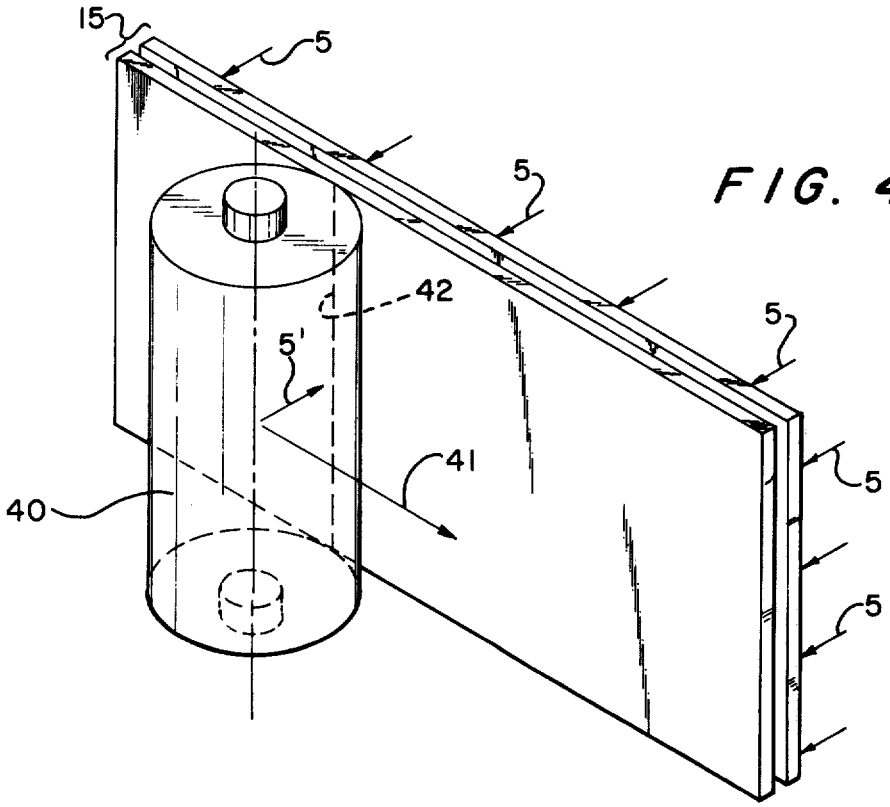

FIG. 4 is a perspective view of a roller applying a scanning pressure to a recording medium.

Figure 5:
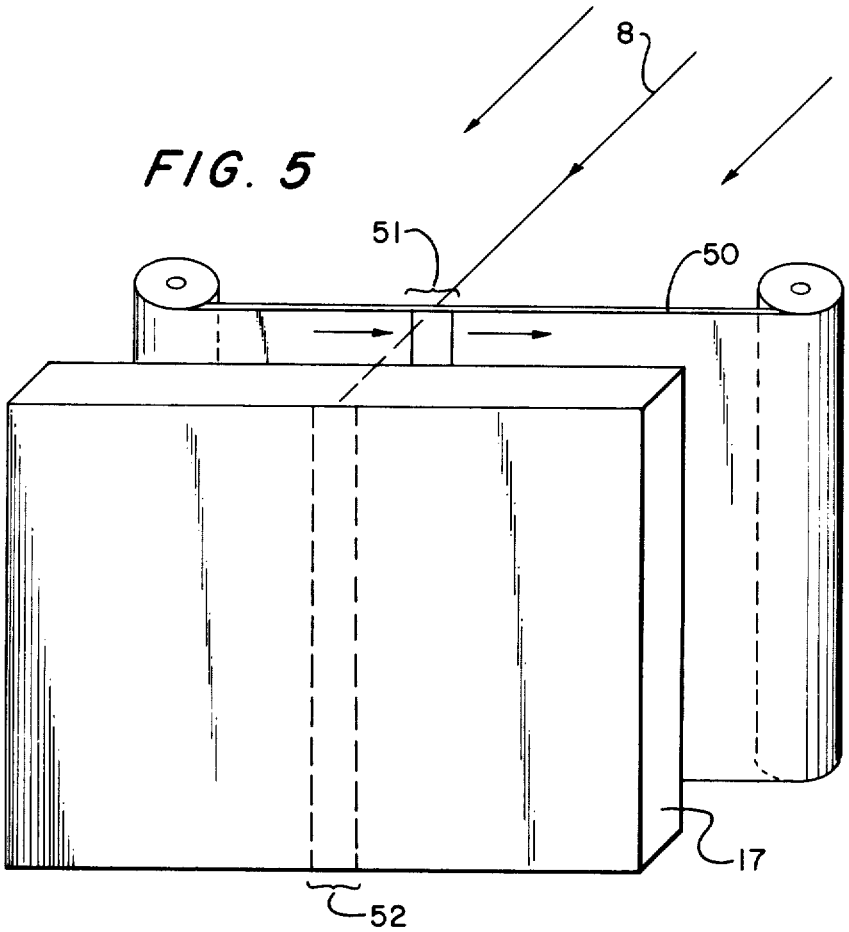

FIG. 5 is a perspective view of a focal plane shutter form of recording control.

Figure 6:
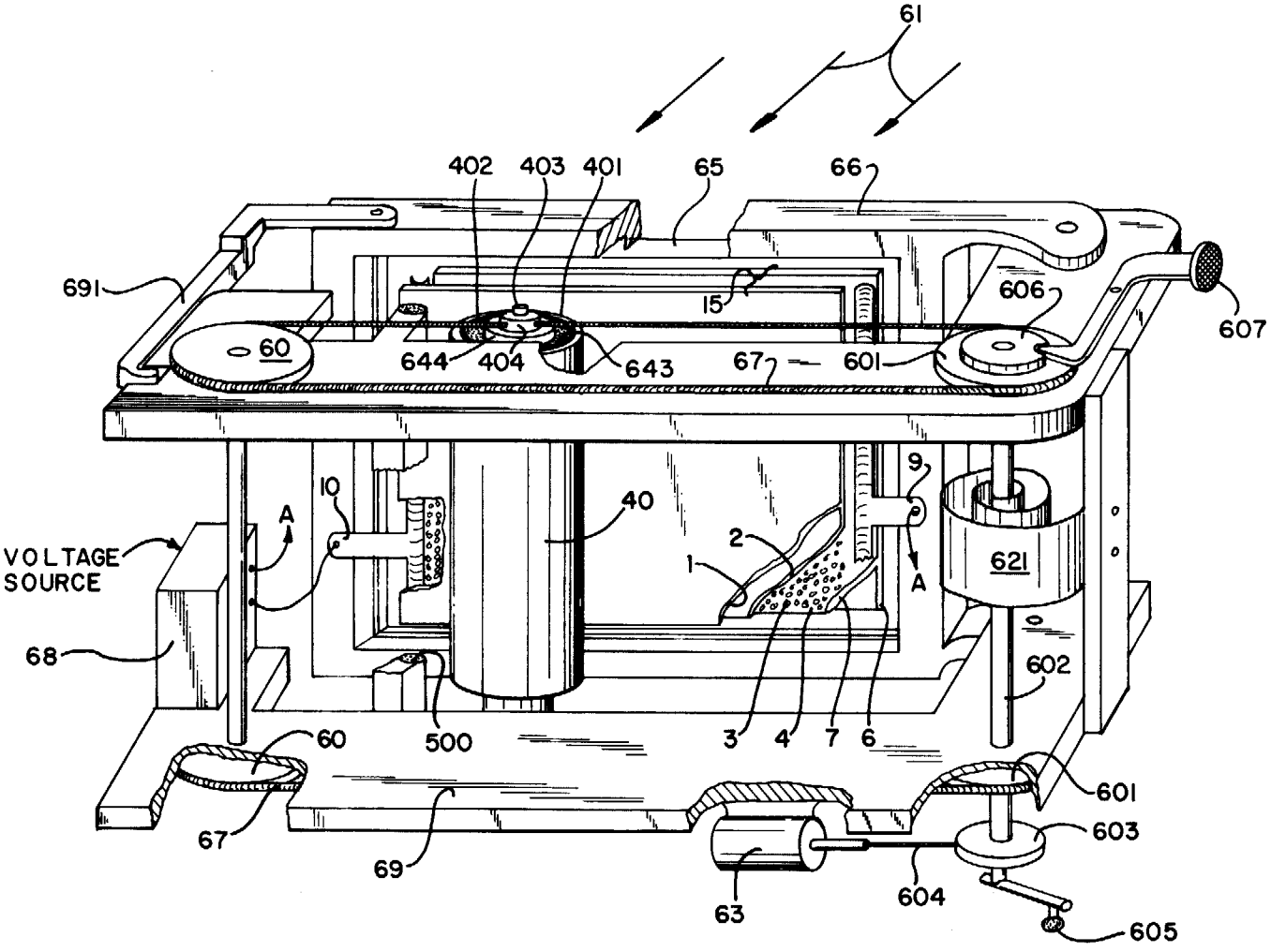

FIG. 6 is a perspective view of a recording system having a roller as a pressure means.

Figure 7:
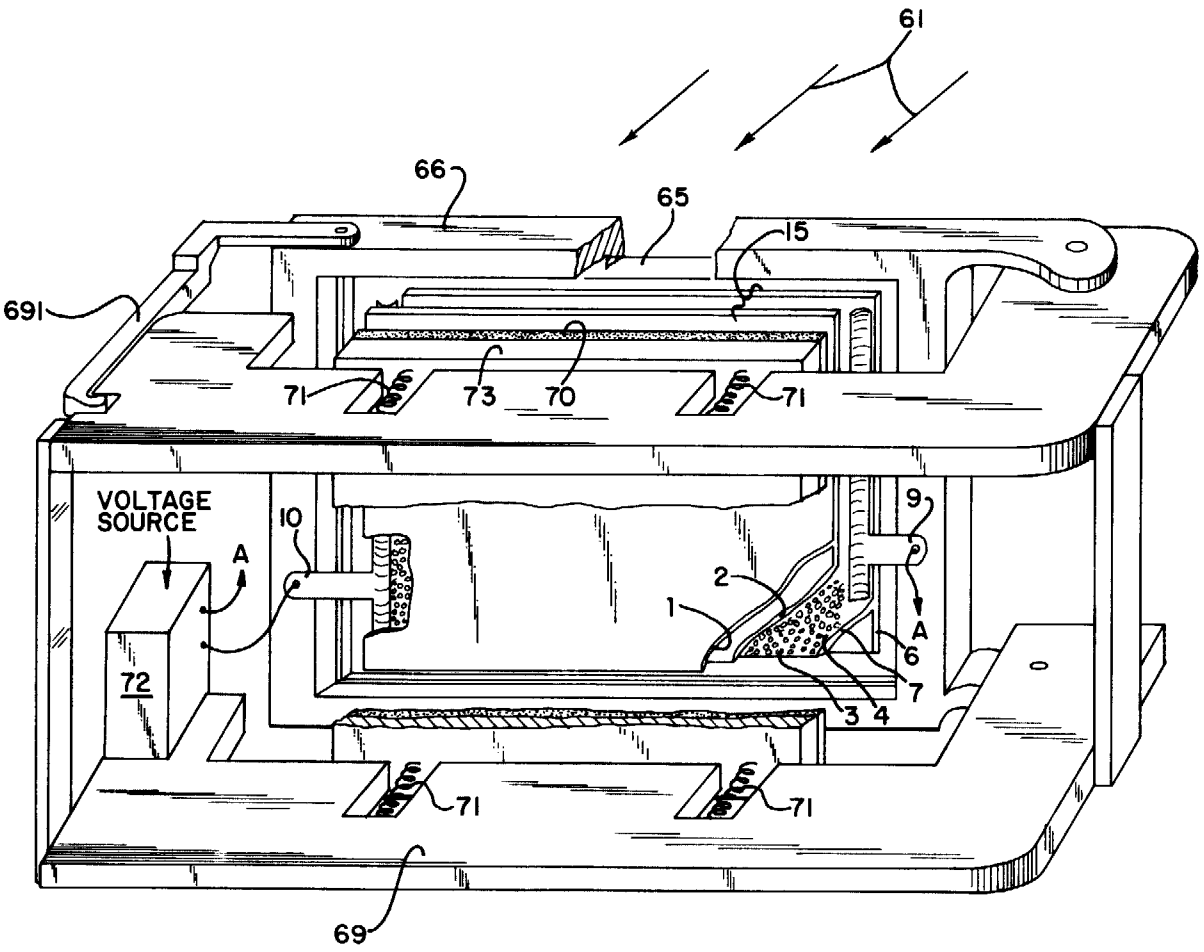

FIG. 7 is a perspective view of a recording system having a pressure pad.

Figure 8:
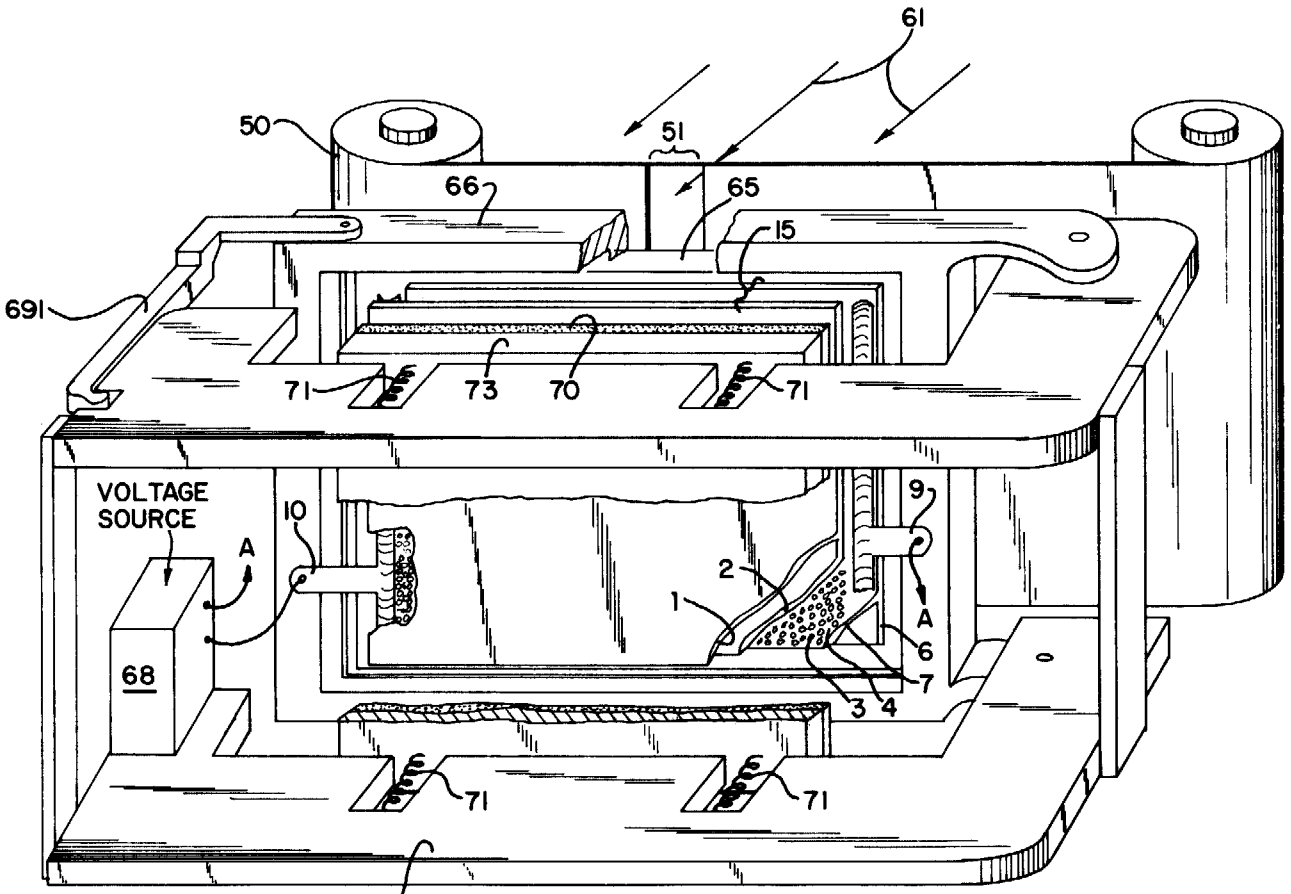

FIG. 8 is a perspective view of a recording system having a pressure pad and focal plane shutter.

FIG. 9–12 are cross-sectional views of other recording media.

Figure 13:
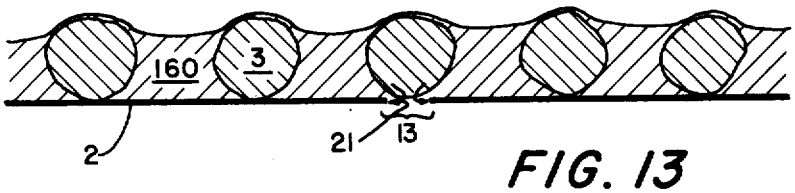
Figure 14:
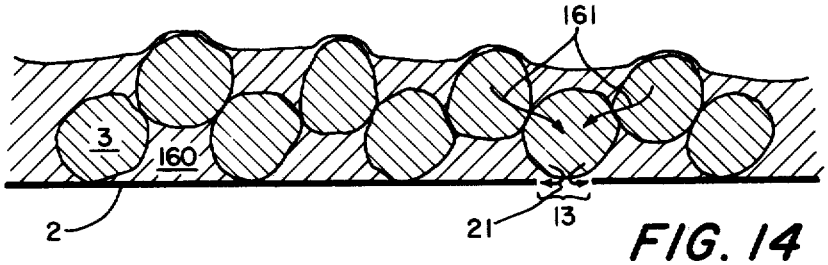

FIGS. 13 and 14 are cross-sectional views of the active layer of other recording media.

DESCRIPTION OF PREFERRED EMBODIMENTS

Part 1

Figure 1:
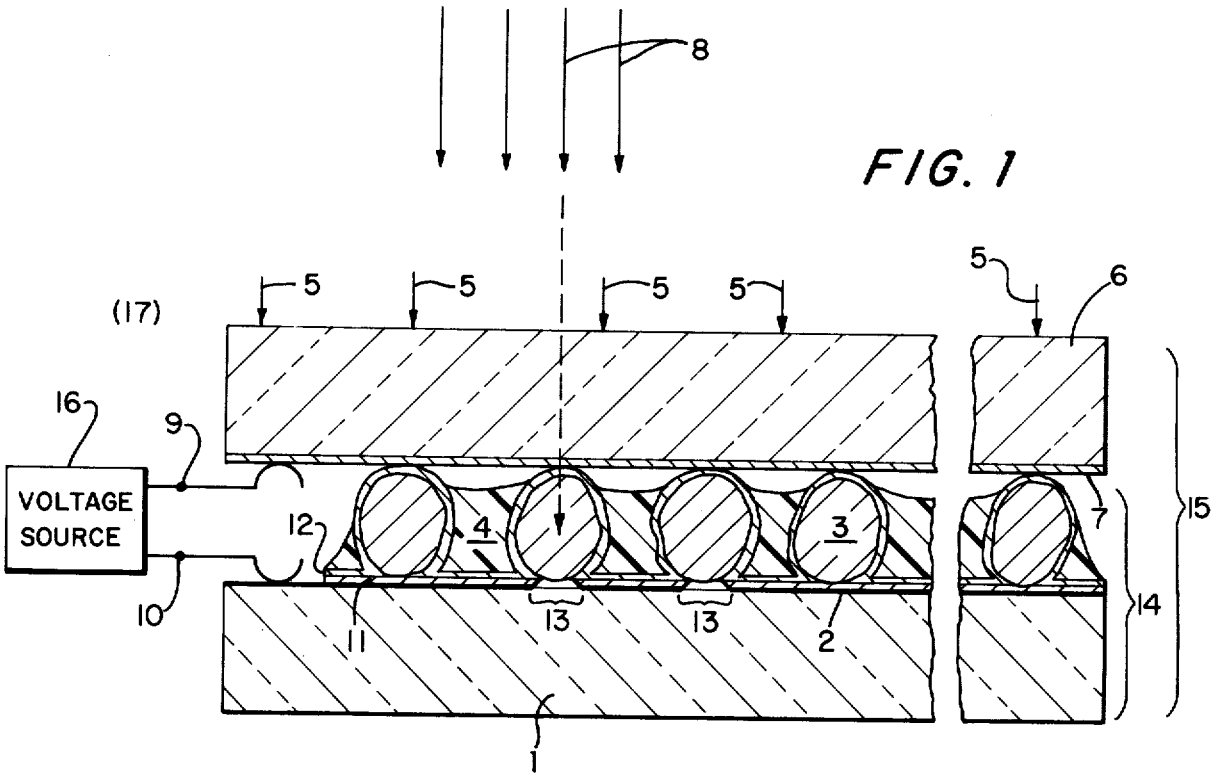
FIG. 1 is a cross-sectional view of one embodiment of the recording medium.

1A. FIG. 1 shows a cross-section view of a preferred embodiment of the recording medium of this invention by which a positive transparency can be obtained. It consists of a transparent plastic sheet 1, the first substrate, typically ½ mil in thickness, upon which has been deposited a thin opaque layer 2 of easily heat disintegrable material, such as aluminum having a thickness of several hundred Angstroms. Affixed to the aluminum is a single layer of granules 3 of photoconductive or ionization conductive powder, preferably copper-doped cadmium sulfide. Granule sizes ranging from 3 to 25 microns have been successfully used. The particular granule size to be used in the construction of the recording medium depends upon the desired resolution. The granules in the layer should be approximately of the same size. Germanium, indium antimonide, gallium arsenide, cadmium sulfide, silicon, organic semiconductors, silver iodide and other similar photoconductors are other possible photoconductors which might be used instead of the copper-doped Cds.

These granules are held in position and kept separated by the base binder 11 and the top binder 12 which preferably are very thin shellac layers. The combination of biner 11 and 12 is termed the first dielectric. These layers are so thin that they do not form an electrically insulating layer on the granules. These layers provide for a non-ohmic electric contact by the granules to the electrodes, since shellac is a poor insulator having some intrinsic conductivity. The interstitial spaces between the binder-coated granules are filled with the lateral filler material 4, the second dielectric, which is an electrical insulator resistant to thermal disintegration or erosion. A suitable lateral filler material is polyvinyl acetate. This assembly of the binder-coated granules, lateral filler and aluminized first substrate is designated as the radiation sensing member 14.

A second transparent substrate 6, preferably glass, having a transparent electrically conductive lower surface 7, e.g., a tin oxide coating, is placed adjacent to the granules 3. Both substrate 6 and coating 7 are transparent to the radiation or illumination to be recorded whereas substrate 1 is transparent to the visible portion of the spectrum. The substrate 6 could also be fabricated of clear plastic or other suitable transparent material. in this case, the conductive layer 7 would be a thin layer of gold which would have the desired conductivity and tranparency. Other transparent conductive coatings may be suitable.

A pressure 5 is applied against the substrate 6, forcing the conductive layer 7 into electrical contact with the granules 3 by means of the intrinsic conductivity of the top binder 12. A counterbalancing force is applied to substrate 1 by mechanical means to be described later. Thus, electrical contact is established from the conductive layer 7, the top electrode layer, to the granules 3; and from the granules to the electrically conductive layer 2 by means of the intrinsic conductivity of the base binder 11, the base electrode layer.

If desired a thin layer of electrically conductive grease or oil may be applied over the binder coated granules to improve the electrical contact to the top electrode. A suspension of fine metallic particles in the oil helps in this regard.

Figure 2:
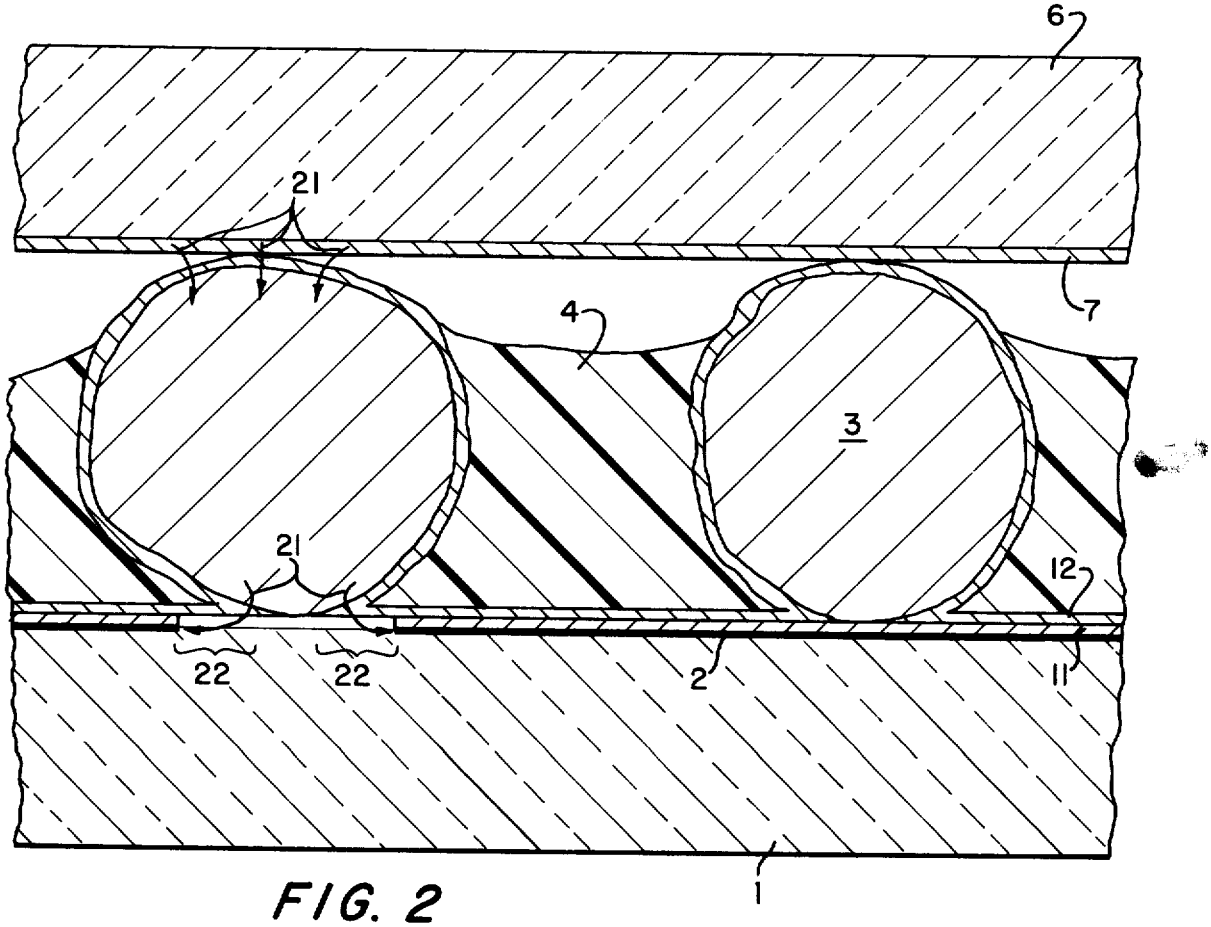
FIG. 2 is a cross-section detail view of FIG. 1.

Additional improvement can be obtained if that portion of top binder 12 which is in contact with top conductive layer 7 of FIGS. 1 and 2 is removed so that layer 7 is in direct contact with photoconductive granule 3. This removal can be effected by wiping a sensing member 14 with an alcohol impregnated wiper which will disolve and remove the shellac from the tops of the granules adjacent to layer 7. The binder 12 was originally applied for the purpose of securing the photoconductive granules 3 during the application of lateral filler 4.

The same is true for the top binder and top buffer of the other embodiments of the recording mediums described in this application.

The illumination or radiation 8 to be recorded is incident on transparent substrate 6 and is transmitted through said substrate to the granules 3. This illumination can be visible light although it could range from the infrared up to very high photon energies corresponding to the range of sensitivity of photoconductors available.

An electrical potential is applied between the top and base electrode layers 7, 2 through spring contacts 9, 10, respectively, which are connected to voltage source 16. This voltage is typically 40 to 100 volts, depending on construction details such as granule size and binder thickness. The voltage can be a DC voltage of either polarity, and AC voltage, a sequence of voltage pulses; each having a constant envelope or a ramp envelope. The particular voltage wave used is determined by the specific recording system in which the recording medium 15 is employed.

If a given granule has no illumination on it, only a small dark current will flow through it. If the granule is illuminated, however, a substantial current will flow resulting in an elevation of its temperature. This increased temperature further increases the granule's conductivity, which in turn increases the temperature. This process continues until very high temperatures are achieved. This rapid increase in temperature is interrupted in one of two ways. The manner of interruption will be discussed in paragraphs 1B and 1C.

1B. The temperature increase is terminated when the temperature at the base of the granule causes a local melting and vaporization., heat disintegration, of the aluminum layer 2 which interrupts the electrical contact. The aluminum layer is sufficiently thin that the vaporized aluminum combines with adjacent material so that a transparent spot 13 is created in the otherwise opaque aluminum layer. This type of termination generally occurs when very good electrical contact by the granules to the top and base electrode layers exists.

1C. The temperature increase may also be terminated when the electrical contact of the granules to the top and base electrode layers is not exceedingly good. Here the temperature increases more slowly until the current has risen to the point at which the area of poor electrical contact to the electrode layers in the top and/or base binder suffers an electrical breakdown. This initial breakdown rapidly develops into a spark or arc fron one electrode layer through the granule to the other electrode layer and will cause an erosion, also heat disintegration, of the aluminum directly below the granule.

A function of the lateral filler material 4 is to quench this arc when the erosion below the granule has formed a hole about the size of the granule. FIG. 2 represents how this self quench is achieved. As erosion occurs, the expanding arc 21 is constricted by the electrically insulating erosion resistant lateral filler material 4 in the region 22. The increased arc length and constricted area causes the arc maintenance voltage to rise until it exceeds the voltage applied, at which time quench occurs. The applied voltage and lateral filler material determine the hole size which is produced. In addition, the lateral filler incidentally provides shielding for adjacent granules from the light emitted by the arc of other granules. Thus regardless of the manner of interrupting the temperature increase, the basic objective has been achieved, that is, incident illumination or radiation has triggered a process that has created a transparent spot 13 on the aluminized plastic sheet 1. This hole erosion process occurs under each illuminated granule. Thus if the incident illumination was in the form of an image or pattern focused on the plane of the granules, a positive transparency recording of this image will have been produced.

Although the base electrode layer 2 has been described as a layer of aluminum, other easily eroded (heat disintegrable) metal layers such as tin can be employed. The propensity for such erosion of a variety of materials is discussed in the article "Electrode Erosion in Spark Discharges,"Vargo and Taylor, J. App. Physics, Vol. 33, No. 9, pp. 2911-12, 1962, in which the measured erosion rates for tin, copper, titanium, tungsten and molybdenum are given.

Figure 3:
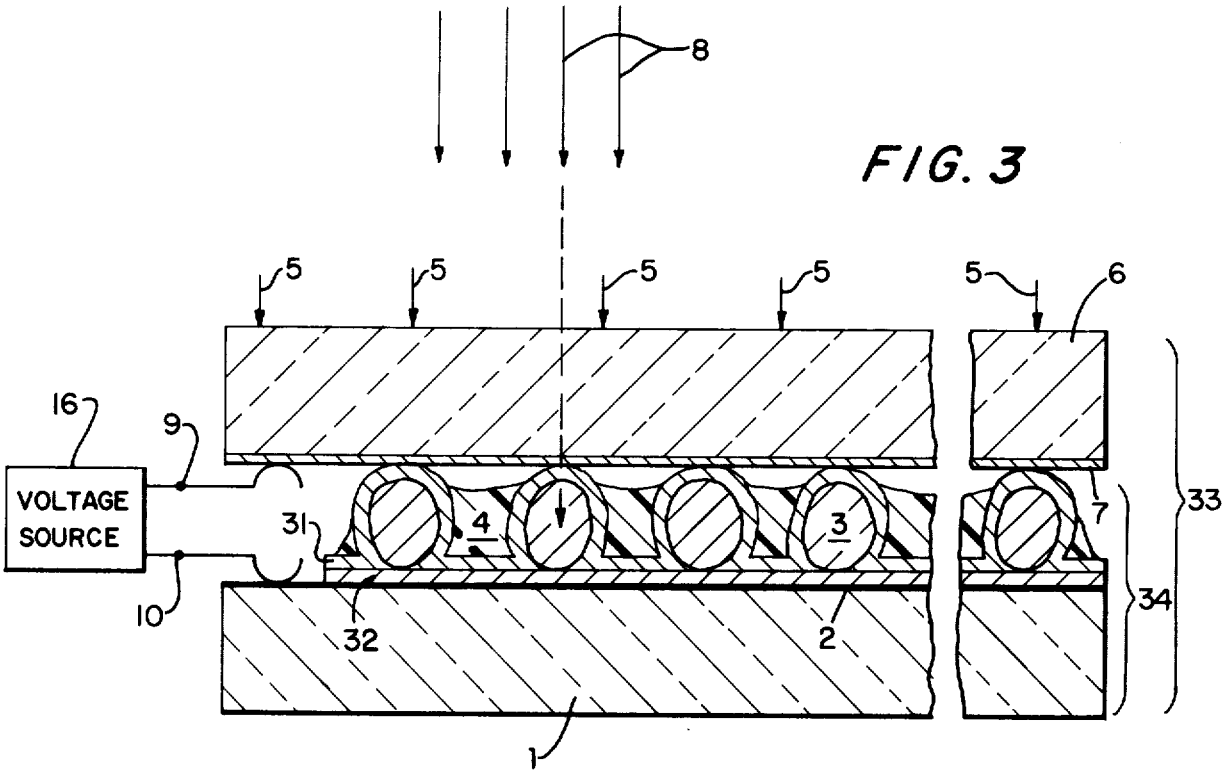

1D. A variation of the design of the recording medium of FIG. 1 is shown in FIG. 3. The recording medium of this design has increased sensitivity to incident illumination. The construction is essentially the same as in FIG. 1 except that the layers 31, 32 are thicker than layers 11, 12, so that they function as low-breakdown-voltage insulating layers. These layers still have an intrinsic conductivity but due to their thickness have a higher resistance than did layers 11 and 12. These layers constitute an insulating first dielectric, the upper part of which is referred to as the top buffer 31 and the lower part as the base buffer 32. For an unilluminated granule, a substantial fraction of the voltage from source 16 appears across the granule with the remainder across the top and base buffers 31, 32 being less than their breakdown voltage.

When a small amount of ionization is produced in the photoconductive material 3 by illumination, the electric field to which the top and base buffer are subjected is greatly increased over the field present for no ionization. This is due to the relatively high conductivity of the ionized photoconductor 3 relative to that of the top and base buffer. This high electric field will trigger a breakdown of the buffer material. Thus a small amount of ionization, which is insufficient to initiate the arc with the FIG. 1 design, is sufficient to trigger breakdown with the FIG. 3 design. The end result is that the FIG. 3 design will be more sensitive to incident radiation or illumination. Upon initiation of the arc, the operation in terms of aluminum erosion and quench is the same as in paragraph 1C.

1E. If the illumination to be recorded extends over a large fraction of the area of the recording medium, there would be a large number of simultaneous hole eroding arcs or holes being melted; thus resulting in very large currents having to be carried by the top and base electrode layers. Since this current can easily exceed the current-carrying capacity of the conductive layers, it is necessary to limit the number of hole erosions that are simultaneously in progress by a form of recording control. The recording control can be accomplished by the scan technique illustrated in FIG. 4. A roller 40 produces a force 5' against recording medium 15 along the line 42. This force is counterbalanced by the pressure 5 applied to substrate 6. During recording, the roller 40 moves across the substrate 1 in the direction designated by direction arrow 41. As the roller 40 moves, all the binder or buffer coated granules are sequentially pressed into good electrical contact with the top electrode layers 7 by the force 5'. Although the image to be recorded is applied to all the granules, only those granules which are both illuminated and under pressure will draw significant current at any given instant. Thus the recording process takes place over the period of time, the recording time, during which the roller scans the recording medium 15 and the current is provided by source 16 during this period.

1F. An alternate means of controlling the time of recording is to apply a uniform pressure over the entire area and to simultaneously sweep the applied voltage. The swept voltage starts at a lowest critical voltage and increases to a highest critical voltage in a ramp waveform over a period of time which is designated the recording time. The lowest critical voltage is defined as that voltage which is capable of causing an arc or hole melting of the base electrode layer at the location of the most sensitive of the illuminated granules. As the applied voltage is increased from this lowest critical voltage, a progressively larger fraction of the illuminated granules will have recorded. This will continue until a highest critical voltage is reached which corresponds to the voltage at which essentially all of the illuminated granules will have recorded. Thus, the current drawn by the recording medium is limited primarily to the current drawn by only those granules that are in the process of eroding or melting a hole since those granules which have completed their recording process are no longer drawing current.

1G. Another structure for limiting the current in the recording process employs what is generally termed a focal plane shutter, Such a structure is shown in FIG. 5, which shows the recording assembly 17 of FIG. 1, to which is applied a uniform pressure (not shown) over its entire surface of substrate 1, the focal plane shutter 50 and its moving slit 51. The focal plane shutter 50 operates as a conventinal shutter to allow only a small region 52 of the recording area of medium 15 to be exposed to the input illumination 8 at a given time. The entire area is exposed in time sequence as the shutter slit 51 traverses the area of the recording medium during the exposure time which for this structure is also the recording time.

1H. At this point, the means of employing the recording medium of either FIG. 1 or FIG. 3 into an image-recording system, commonly termed a camera if the radiation being recorded is light, will be discussed. The image-recording system is shown in perspective view in FIG. 6. The impressed illumination 61, which is in the form of an image or pattern, is focused on the plane of the granules of the recording medium 15. A voltage source 68 provides either a d.c., a.c., or pulsed voltage. This source provides a voltage sufficient to produce recording as described earlier, said source being connected to recording medium 15 by the top layer electrode 9 and the base layer electrode 10. A roller 40 provides a scanning localized pressure against the recording medium 15. The recording medium 15 is supported to resist the roller force by a transparent rigid pressure plate 65, a glass plate for example, which is supported around its periphery by the bracket 66. The roller 40 is movably supported on supporting structure 69. Structure 69 is connected by a hinge to bracket 66 and latched in a closed position by latch 691 so that the roller 40 is pressing against medium 15. The roller 40 is moved by flexible wire rope cables 67 which are guided by pulleys 60 and driven by pulleys 601. The wire cables 67 are attached to bushing 404 which is rotatably mounted on roller shaft 403. Pulleys 601 are turned by rotary power spring 621, both of which are connected to drive shaft 602. The rotary motion of pulleys 601 is moderated by dash pot 63 which is connected to pulley 603 by wire rope 604 to cause the roller 40 to move with relatively constant speed across the recording medium 15. Pulley 603 is also connected to drive shaft 602.

The recording system of FIG. 6 is ready for recording the impressed radiation 61 when the roller 40 in its leftmost position at one edge of the recording medium 15 and the spring 621 is wound. The roller is held in this position against the force of the spring by trigger lever 607 in engagement with a detent in pulley 606. Pulley 606 is also affixed to the drive shaft 602.

In order to record the image focused on the granules, lever 607 is depressed to release pulley 606. Roller 40 then proceeds to scan across to the other edge of the recording medium 15. The voltage source 68 must be on during the roller traversal. At the termination of the roller traversal, the recording process is complete.

In order to replace the expended recording medium 15, the latch 691 is released and bracket 66 is swung away from supporting structure 69. When structure 69 is in this unlatched position, the roller 40 is returned to the leftmost position by turning crank 605, which also winds power spring 621. An unexpended frame of recording medium 15 can now be inserted.

The roller 40 has an exterior firm cylindrical shell 401, which may be of nylon. The shell 401 is mounted on a thin-walled steel cylinder 402 to provide strength. A rubber resilient cylinder 643 connects steel cylinder 402 to the shaft 403. The force 5' of FIG. 4 is applied to shaft 403 by the rotatable bushing 644 which also presses against and rolls on supporting structure 69. The force 5' is transmitted from shaft 403 through the resilient cylinder 643, which undergoes a compression in the region facing the recording medium 15. An additional function of the resilient cylinder 643 is to provide a relatively constant force as the roller 40 traverses the medium 15.

A resilient pressure pad 500 is attached to support structure 69 to provide a force against substrate 1 to counterbalance the force of electrode 10 against base electrode layer 2. This feature provides a broad area electrical contact to base electrode layer 2 thereby distributing the recording current to avoid high level current densities. The resisting force for electrode 9 is provided by pressure plate 65.

Although the embodiment of the recording system shown in FIG. 6 shows a single frame of the recording medium 15, it is apparent that where recording medium 15 is flexible as in the case whre substrate 6 is a thin plastic sheet, that the individual recording frames could be mechanically joined to one another as by being mounted on a length of continuous transparent plastic sheet, thus forming a strip. The strip could be mounted on spools as in a conventional camera. The structure of FIG. 6 could be modified to include spool mounting brackets affixed to bracket 66. Where a spool-fed strip is employed, it may be desirable to avoid releasing latch 691 each time the strip is advanced and the roller 40 recocked. In this case, the construction of bracket 66 is modified to cause the pressure plate 65 to be moved away from the roller by a pressure release lever when the strip is to be advanced. Electrode 10 would be mounted to move with pressure plate 65 to release its pressure.

A second embodiment of a recording system is shown in FIG. 7 and differs from that described in FIG. 6 in that a uniform pressure is applied to the recording medium 15 instead of a local scanning pressure as by the roller 40. This uniform pressure is provded through the action of springs 71 acting upon the rigid backing plate 73 which is bonded to resilient pad 70 in contact with the recording medium 15.

When it is desired to record the image or pattern focused on the granules, a ramp output voltage is initiated by the voltage source 72. The recording process as described in section 1F is complete when the ramp waveform voltage reaches the highest critical voltage and the voltage source 72 then ceases to provide a voltage. An alternative source that can be employed is one that provides an alternating or pulsed voltage modulated by the ramp envelope.

A third embodiment of a recording system is shown in FIG. 8 and differs from that described in FIG. 7 in that the voltage source 68 is not a ramp source but is a d.c., a.c., or pulsed source; and a focal plane shutter 50 is interposed between the impressed image illumination 61 and the pressure plate 65. When it is desired to record the image or pattern focused on the granules, the voltage source 68 is turned on and the focal plane shutter 50 is activated to scan over the recording medium 15.

The recording medium 33 of FIG. 3 can be substituted for the recording medium 15 in the preceding discussion of the recording systems.

1I. It is possible to record selected photon energies or energy bands such as specific colors in the case of visible illumination. This can be accomplished to some extent by proper selection of the ionizable conductive material (photoconductor) of the granules to have a high ionization cross section (photoconductivity) between the particular energy bounds of interest. This will yield a much higher conductivity and hence higher probability of arc initiation or hole melting between the desired energy bounds. An examination of the photoconductive materials discussed in section 1A indicates that a broad range of sensitivity energies is possible. These energies range from the very high electron volt region to just one or a few electron volts. A recording medium such as in FIG. 1 or FIG. 3 may be constructed to have a mixture of granules of different sensitivity energies, thus allowing the recording of the distribution of incident radiation having corresponding energies. For example, in the case of visible illumination, three types of granules could be included in the mixture such as red, green and blue sensitive. Further, if each of these classes of granules were dyed or otherwise colored in correspondence with the sensitivity color, the end result of the recording process would yield a colored positive transparency. Thus, a red-sensitive granule will have a hole eroded under it only if the light illuminating it contains a red component. Therefore, the read-out or projection with white light of the recorded radiation will project this hole as a red spot. This comes about because the white light comes through the eroded hole and is given a red hue by the red particle residing in front of the hole. Conventional transparency projection apparatus can be employed to project either the colored or uncolored image recordings of this invention.

The coloring of a red granule can be achieved by applying a thin layer of shellac less than 0.1 $\mu$ thick, in which has been embedded a fine granular red pigment. This red pigment is absorptive of green and blue light and transmission of red. By this technique, granules of photoconductive material that are broad spectrum sensitive are rendered sensitive only to the pigment color through the filtering action of the pigmented shellac coating. The shellac coating is sufficiently thin not to interfere with electrical contact to the granule. Other materials could be used instead of shellac to retain the pigment. Green and blue sensitized granules are obtained in the same manner by appropriate pigment selection.

1J. In the description to this point, holes resulting from illumination were of fixed size, determined only by the method of quenching the erosion, and in general were about the size of the granules. In the case of use of as a photographic recording medium, the varying shades of gray are achieved by the varying density of these holes of fixed size. Similarly, in the case of a colored recording, the varying hues of color are produced by the varying density of each of the three primary color holes.

The size of the holes can be varied in proportion to the incident illumination to yield better resolution and hue control. This can be accomplished by applying a pulse train waveform voltage to the granules, with the individual pulse lengths equal to or slightly greater than the time T required for the hole erosion process to occur ($T \simeq 0.2$ $\mu$sec). T is the time during which the granule temperature rises rapidly and the hole melting or arc erosion takes place. This time is, however, not fixed but is dependent on the illumination, i.e., for high illumination T is shorter than for low illumination. Thus, for a fixed pulse width of the order of 0.2 $\mu$sec those granules which are highly illuminated will have sufficient time to complete the hole erosion to the final maximum size determined by the physical construction of the recording medium (quenching mode). However, those granules less brightly illuminated will have their erosion sequence interrupted by the end of the pulse before reaching maximum hole size. A hole that has been eroded to less than its maximum size by the termination of a pulse will not continue to erode on subsequent pulses because its electrical contact will have been destroyed by the action of the pulse that caused the initial erosion. Thus, the hole size will bw proportional to the illumination intensity. This high frequency pulsing can be applied either as a sequence of pulses of equal amplitude or as pulses within a ramp envelope, thus making it applicable to all the recording control means discussed above. These pulses can be obtained by modifying the previously discussed voltage sources of FIGS. 6, 7 and 8 to include the high repetition rate pulse feature by conventional pulse circuitry.

1K. The method of fabrication of the recording medium of FIG. 1 will now be discussed. The first substrate with its vapor deposited opaque conductive layer is commercially available in the form of aluminized polyester films. A layer of shellac about 0.15 μ thick is sprayed on the conductive coating and allowed to dry, thus forming the base binder 11 of the first dielectric. Photoconductive granules about 15 μ in size are then dusted onto this surface with those granules that do not adhere to the dried shellac shaken off, thus leaving a one-granule-thick layer. The granules which are very uniform in size, 90% falling between 14 and 17 μ in diameter, are obtained by screen filtering through two different screen meshes which bracket the desired granule size. A second layer of shellac is sprayed over the granules, thus forming the top binder of the first dielectric and is about 2.5 μ in thickness and is allowed to dry. Polyvinyl acetate is spread with a knife edge to fill the interstitial spaces between the binder-coated granules, thus leaving the outermost surface of the granules substantially uncoated with the lateral filler, the second dielectric. The second dielectric is allowed to dry to a solid. This surface is sprayed with a solvent, water, of the second dielectric. The surface is wiped with an absorptive material to remove any of the second dielectric that remains on the tops of the granules.

The second substrate with its electrically conductive transparent coating is a commercially available product in the form of tin oxide coated glass, generally referred to as infrared reflecting glass. Alternatively, the second substrate can be a clear flexible plastic such as polyester film with the conductive layer being a vapor deposited layer of gold yielding the desired conductivity and transparency.

The method for fabricating the recording medium shown in FIG. 3 is similar to the above method except that the base buffer 32 of the first insulating dielectric is a shellac layer 5–10 μ and the top buffer 31 of the first insulating dielectric is a shellac layer 5–10 μ thick. These layer thicknesses are sufficient to substantially interfere with the current flow as described in section 1D, whereas the thicknesses used in the method for fabricating the medium of FIG. 1 are not.

PART 2

Figure 9:
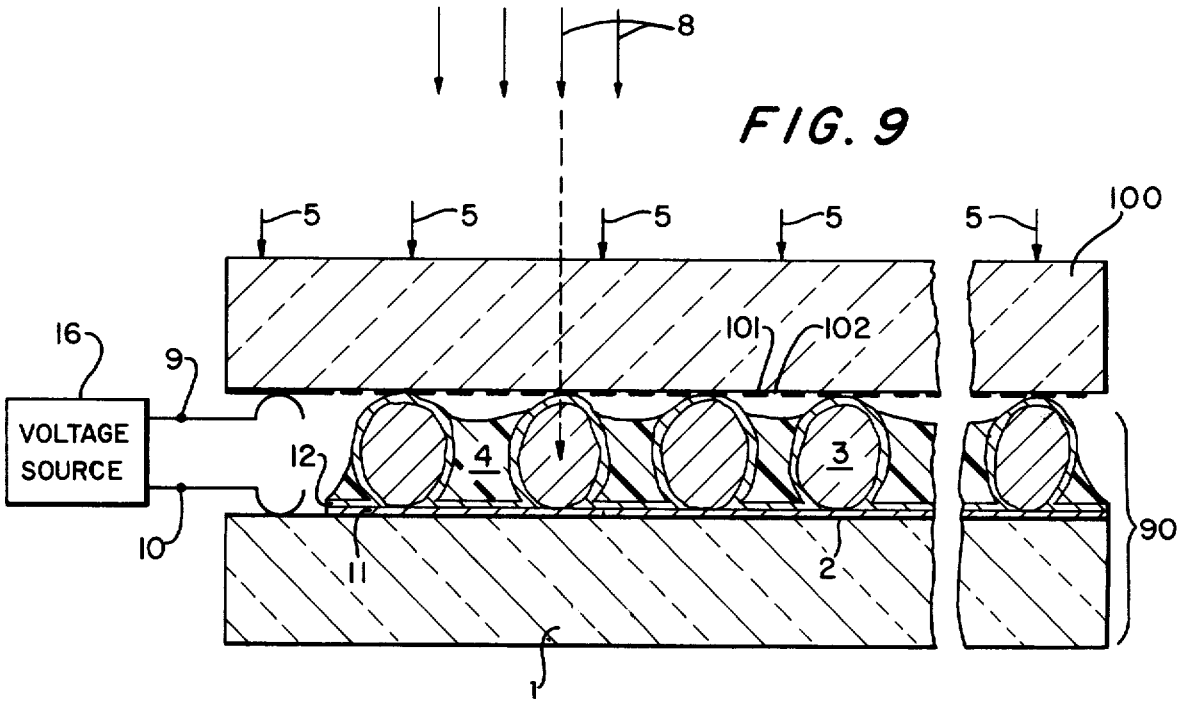

2A. FIG. 9 shows a cross-sectional view of another recording medium by which a positive transparency can be obtained. The radiation sensing member 90 is the same as member 14 of FIG. 1 or member 34 of FIG. 3. The second transparent substrate 100, preferably a thin transparent plastic sheet, has on it a perforated opaque conductive layer, the top electrode layer 101, which is preferably a zinc layer. This layer 101 has a multitude of small perforations 102 through it to form a light transmissive screen which is electrically conductive. These perforations, which are smaller than the granules, allow the incident radiation or illumination 8 to enter the granules, while still allowing the granules to make electrical contact to the layer 101. Pressure is applied as in FIG. 1 to achieve electrical contact between the granules and the top electrode layer 101. A voltage source 16 is applied between the top electrode layer 101 and the base electrode layer 2.

The recording medium of FIG. 9 differes from that of FIG. 1 or FIG. 3 only in the structure of the top electrode layer but otherwise is the same in all respects. Therefore, the discussion in Part I pertaining to operation and utilization of the recording medium apply to the recording medium of FIG. 9.

2B. The method of fabrication of the perforated top electrode layer 101 on the substrate 100 will now be discussed. The transparent substrate 100 with an opaque electrically conductive layer of zinc, a few hundred Angstroms thick on it, is a commercially available product (vapor deposited zinc on a polyester film). Although zinc is the preferred material, a thin film of any opaque electrically conductive metal will do. The small perforations in the zinc layer are chemically eroded as follows: a solution of CdCl in water is prepared (most zinc corrosive salt solutions should do) and wiped on the zinc surface. The application to the zinc surface is done by wiping the zinc surface with a sponge soaked with a CaCl solution. Immediately following the sponge application the surface is wiped with a rubber blade squeegee. This results in a thin film of solution remaining on the metal surface, this film being less than $10^{-4}$ of an inch in thickness. Immediately on application the surface tension causes the liquid to form small beads or droplets on the surface, which beads are allowed to air dry. As the beads dry, they become smaller in size and the concentration of the solution forming the beads correspondingly increases. This trend continues until the original weak solution has become more concentrated to erode a hole or perforation in the zinc layer during the period of air drying. The size of the perforation is controlled by the initial concentration used. Typicaly, the zinc layer is 400–500A thick and the initial concentration of CdCl solution is 0.1 normal to produce a perforation about 3 μ in diameter. The surface is then washed in distilled water and the process repeated several times to produce additional perforations until the desired fraction of the surface is covered with perforations. The surface is then given a final distilled water washing and the process of making the screen is complete. All but the last distilled water wash may be eliminated if desired with no apparent difference in the end product. The final distilled water wash removes residual cadmium chloride which remains in the surface after drying and which could otherwise cause a continued slow erosion because of atmospheric mositure.

PART 3

Figure 10:
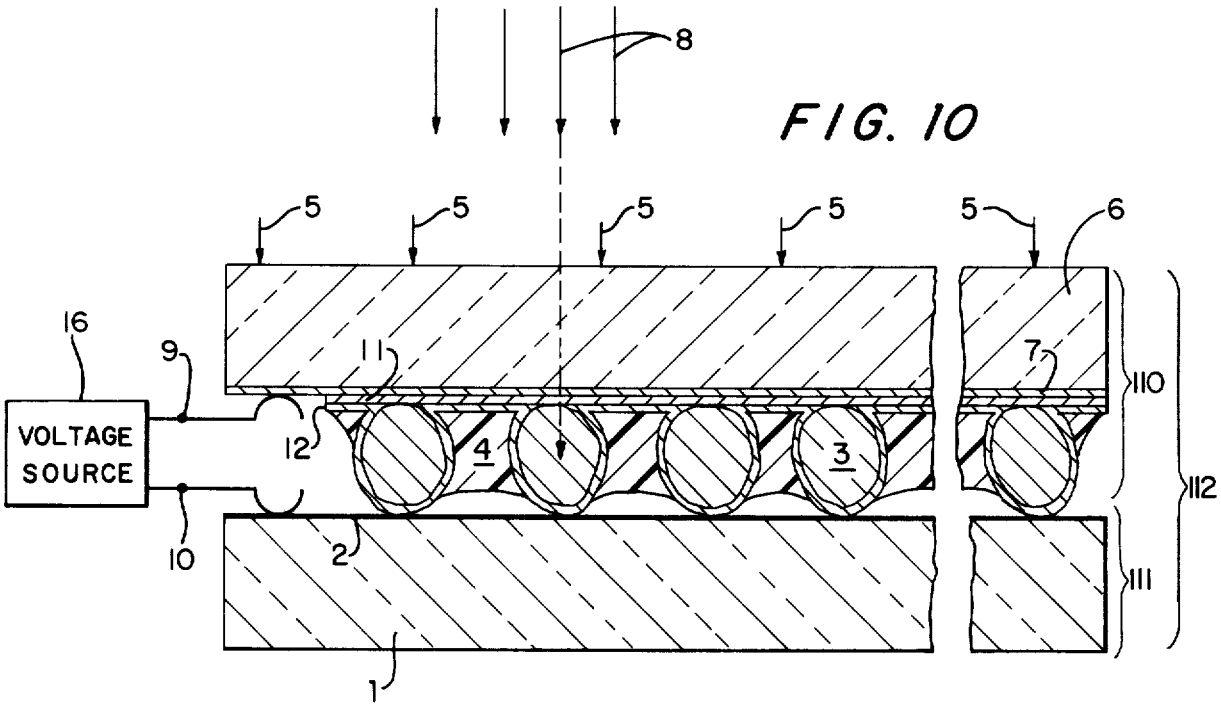

3A. FIG. 10 shows a cross-sectional view of another recording medium capable of providing a positive transparency. The recording medium of FIG. 10 is essentially the same as that of FIG. 1 with the exception that granules 3, the lateral filler 4, and the shellac binding layers 11 and 12 are affixed to the upper electrode layer 7 instead of the base electrode layer 2. The method of affixing the granules is the same as that used for affixing the granules to layer 2, as explained earlier. The pressure 5 is also applied as before to provide electrical contact between the binder coated granules and the base electrode layer 2. The illumination or radiation 8 is applied as before through substrate 6. Recording holes are produced in opaque conductive layer 2 by the action of arc erosion or localized melting when an electrical potential of the type utilized with FIG. 1 is applied in conjunction with pressure 5 and illumination 8, as explained in detail in Section 1A.

The recording medium of FIG. 10 allows for the repeated use of member 110 for many recordings merely by replacement of member 111 for each recording. The tin oxide form of layer 7 is most suitable for this use in that it is highly resistant to degrading through the action of repeated recordings. Member 111 consists of transparent substrate 1 and opaque conductive layer 2. The recording medium of FIG. 10 is suitable only for projection of black and white recorded images since the granules are not attached to the image storing member 111 through which projection is made.

3B. The descriptions contained in sections 1B and 1C apply to the FIG. 10 recording medium with the exception that the arc quenching achieved through the action of the lateral filler is not as effective since the lateral filler 4 is not as proximately located to the opaque conductive layer 2 in FIG. 10 as it was in FIG. 1. Therefore the hole size resulting from given voltage and illumination conditions will be larger for FIG. 10 than in FIG. 1.

The operation and utilization of the recording medium of FIG. 10 is the same as that of FIG. 1 or FIG. 3.

PART 4

Figure 11:
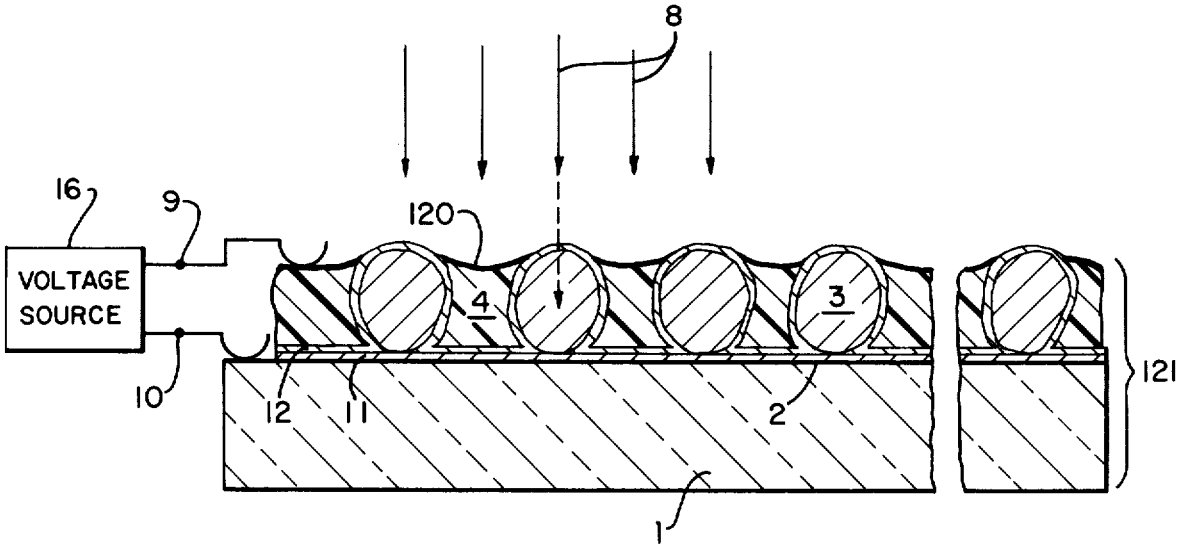

4A. The positive transparency recoring media discussed in parts, 1, 2 and 3 have the common feature of having two distinct elements, such as member 110 and 111 of FIG. 10, which are pressed into electrical contact with one another when recording is to take place. This section will deal with a self-contained (one-element) positive transparency radiation or illumination recording medium. This recording medium is distinguished further from the recording media of parts 1, 2 and 3 in that no mechanical pressire is required during the recording process. FIG. 11 shows a cross-sectional view of the one element recording medium. The construction and method of fabrication is identical to that of FIG. 1 or FIG. 3 with respect to substrate 1, opaque conductive layer 2, shellac layers 11 and 12, lateral filler 4 and granules 3.

A second opaque electrically conductive layer 120 covering the lateral filler 4, while not totally covering the granules constitutes the top electrode layer. Thus, electrical contact is established from the top electrode layer 120 to the binder or buffer coated granules 3, while allowing the incident illumination 8 to reach the granules.

The operation and utilization of the recording medium 121 of FIG. 11 is the same as that of FIG. 1 or FIG. 3 except that no external pressure need be applied to make electrical contact to the granules. Recording medium 121 may be substituted for the recording medium 15 of FIGS. 7 and 8 and may be operated with the voltage sources shown in those figures. Since no external pressure need be applied to recording medium 121, the recording systems of FIGS. 7 and 8 may be modified by the omission of pressure plate 65, the backing plate 73 and pad 70.

The method of fabrication of the recording medium 121 of FIG. 11 is the same as that described in section 1K with regard to the metallized first substrate and the materials applied to it: the base binder 11, the top binder 12, the granules 3, the lateral filler 4, and the polishing operation. The electrically conductive opaque layer 120 of FIG. 11 is a metallic layer a few hundred Anstroms thick which is vapor deposited on the lateral filler and the granules. This layer, which may be aluminum, is then abraded to remove the metal from a substantial portion of the tops of the granules where they emerge above the lateral filler. Thus the incident illumination can enter the granules.

PART 5

Figure 12:
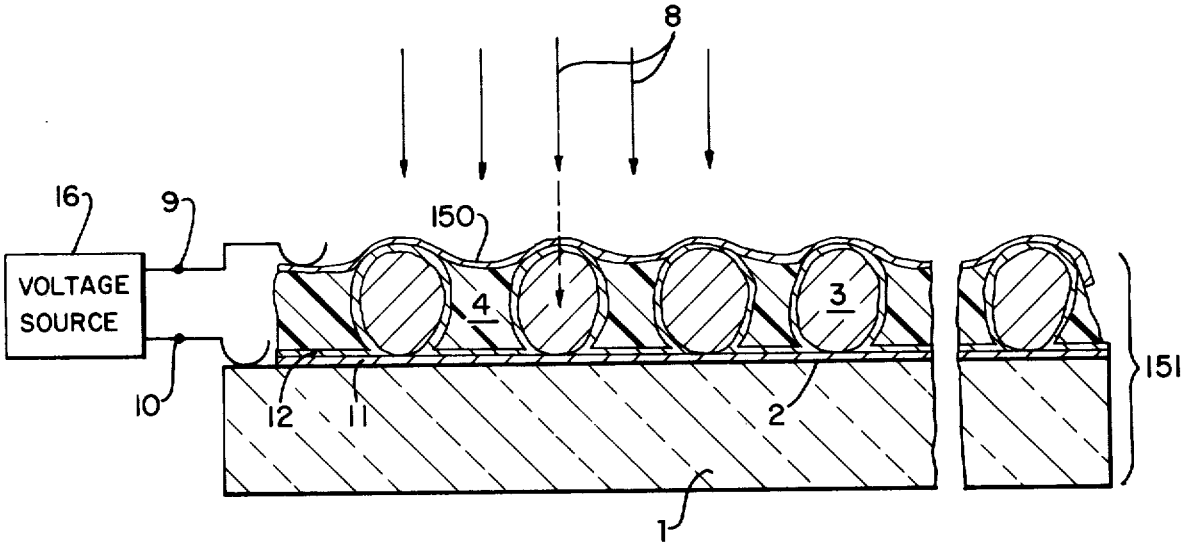

5A. FIG. 12 shows a cross-section view of another one-element recording medium by which a positive transparency can be obtained. The construction is the same as that described in section 4A except that the top electrode layer 150 of FIG. 12 is a uniform electrically conductive layer covering the lateral filler 4 and the granules 3. This layer is transparent to the incident illumination or radiation 8 and makes electrical contact to the top surface of the binder coated granules. In the case where the illumination is visible light, this layer 150 is a transparent electrically conductive layer of gold which is in electrical contact with the binder coated granules 3.

5B. The method of fabrication of the recording medium of FIG. 12 is identical to that described for FIG. 11 except that the top electrode layer 150 of FIG. 12 is formed by vapor depositing a layer of gold over the binder-coated granules 3 and the lateral filler 4.

PART 6

6A. The recording media described previously contained an active layer which consisted of the base electrode layer, the base binder or base buffer, the granules, the top binder or top buffer, and the lateral filler. FIG. 13 shows a modified form of active layer which may be used alternatively in each preceding form of recording medium. It differs in that a single material, the filling binder 160, serves the dual purpose of binding the granules to the base electrode layer 2 as well as quenching the arc erosion process. This form of active layer construction offers an advantage in fabrication since a one-step process can be used in applying the granules and the filling binder.

The filling binder 160 of FIG. 13 holds the granules in position on the opaque layer 2 and fills the interstitial space between the granules. The filling binder 160 is very thin at the tops of the granules where electrical contact is to be made to a top electrode layer, as it is at the bottom of the granules where electrical contact is to be made to the base electrode layer 2. Shellac has been found to be a suitable material for use as the filling binder.

Other dielectric materials would be suitable as a filling binder provided they have the following characteristics. Namely, when in the form of a thin layer at the top and bottom of the granules, electrical contact through the filling binder is possible and is sufficiently non-heat-disintegrable as to be able to effect arc quenching in the region where it acts as the lateral filler. The non-heat-disintegrable property is not as critical in the case where hole erosion occurs by melting. The efficacy with which the filling binder 160 quenches the arcs 21 is diminished from that provided by lateral filler because the filling binder is usually not optimized with respect to the arc quenching function as is the case for the separate lateral filler.

6B. There are applications for the recording medium of the invention where there is no need for color recording and where less resolution is required than is obtained by having the active layer only of one granule thickness. For these applications, economy and ease of fabrication favors an active layer of more than one granule thickness, as shown in FIG. 14. Such an application would be the use of the recording medium as a digital data storage medium where reliability rather than resolution is most important. The active layer construction of FIG. 14 has an advantage in this application where the greater thickness provides multiple paths 161 through the granules, thereby minimizing the criticality of making a good electrical contact through the binder to a top electrode layer by each granule touching it as is desired for the single granule thick active layer. Since electrical contact must be made between granules as well as at the top and base electrode layers, the filling binder must not interfere with such contact.

6C. A desirable feature of using the filling binder 160 for the dual function of binding and quenching is that fabrication is simplified thereby. The filling binder and granules may be applied in a single operation by spraying a mixture of granules and liquid filling binder onto the opaque conductive layer 2. The liquid filling binder is then allowed to air-dry. Where a single layer of granules is desired as in FIG. 13, the liquid filling binder is highly diluted with its solvent, alcohol in the case of shellac, thus extending the time required for solidification and hence allowing the granules to distribute themselves into a single layer through the action of surface tension. The number of granules sprayed on per unit recording area is of course determined by the active thickness desired.

The filling binder, the top and baase binder and the lateral filler, and the top and base buffer and lateral filler all have the common function of quenching the hole-eroding arc or the hole melting process. The three specific configurations will be generically termed the quenching binder.

While there have been shown and described the fundamental novel features of the invention as applied to preferred embodiments, it will be understood that various omissions, substitutions and changes in the forms and details of the devices illustrated and in its operation may be made by those skilled in the art without departing from the spirit of the invention.

What is claimed is:

1. A positive transparent radiation image recording medium for use in conjunction with a voltage source comprising:

a radiation transparent electrically conductive layer, a thin opaque electrically conductive metallic layer of heat disintegrable material, said layers being adapted for connection to said voltage source, a mono-granular layer of photoconductive material comprising photoconductive granules of substantially the same size contained in a quenching binder, said binder also permanently fixing the physical positions of the granules, said layer of photoconductive material is between the electrically conductive layers which make electrical contact to the granules through the portion of the quenching binder between the granules and the conductive layers, said opaque layer is sufficiently thin so that localized holes are produced in it corresponding in location with the radiation image applied through the transparent layer to the photoconductive material because of the heat produced by the current from a voltage applied to the layers, in combination with the radiation, whereby the distribution of said holes over the area of the opaque layer provides a transparency which is a replica of the distribution of the radiation upon said transparent layer.

2. A positive transparency radiation recording medium for use in conjunction with a voltage source comprising:

a radiation transparent electrically conductive layer, a thin opaque electrically conductive metallic layer of heat disintegrable material, said layers being adapted for connection to said voltage source, a mono-granular layer of photoconductive material comprising photoconductive granules of substantially the same size in a quenching binder between the electrically conductive layers, said binder also permanently fixing the physical positions of the granules, said conductive layers and the binder surrounding the granules of the photoconductive material being in mechanical contact and adapted to be in non-ohmic electrical contact through the insulating layer of the quenching binder which is between the granular and the conductive layers through mechanical pressure applied to said conductive layers, said opaque layer is sufficiently thin so that localized holes are produced in it, corresponding in location with the radiation image applied through the transparent layer to the photoconductive material, because of the heat produced by the current from an applied voltage in combination with the radiation, whereby the distribution of said holes over the area of the opaque layer provides a transparency which is a replica of the distribution of the radiation upon said transparent layer.

3. An image recording medium responsive to incident radiation comprising:

a first transparent substrate, a thin opaque electrically conductive heat disintegrable metallic layer on said substrate, a dielectric binder, an electrically insulating, erosion resistant lateral filler material, a plurality of photoconductive granules of substantially the same size in a mono-granular layer adhered to the opaque conductive layer by the binder and with the lateral filler material filling the interstitial space between the granules and leaving that portion of the surface of granules furthest from the opaque conductive layer not covered with the lateral filler, said binder also permanently fixing the physical positions of the granules, a second substrate transparent to said radiation, a radiation transparent electrically conductive layer on said second substrate and in contact with said granular layer, said structure being capable of electrical conduction between the electrically conductive layers through the dielectric binder.

4. The image recording medium of claim 3 wherein said binder comprises:

a base binder adhering said granules to the opaque conductive layer, a top binder covering the granules and the base binder.

5. The product of claim 4 wherein the binder is shellac.

6. The product of claim 4 wherein the lateral filler is polyvinyl acetate.

7. The product of claim 3 wherein the opaque conductive metallic layer is easily heat disintegrable.

8. The product of claim 7 wherein said metallic layer is a layer of aluminum preferably a few hundred angstroms in thickness.

9. The product of claim 3 wherein said transparent conductive layer is tin oxide and said second substrate is glass.

10. The recording medium of claim 3 wherein:

the plurality of photoconductive granules are comprised of at least two types of granules, each type being selectively photoconductively responsive in a specific spectral range and also having a color providing enhanced transmission of light in the same spectral range, said types being interspersed randomly over the first substrate.

11. The image recording medium of claim 4 wherein:

said base binder is a thick layer thus constituting the base buffer, said top binder is a thick layer thus constituting the top buffer.

12. An image recording medium responsive to incident radiation comprising:

a first transparent substrate, a thin opaque electrically conductive first metallic layer on said first substrate, a dielectric binder, an electrically insulating, erosion resistant lateral filler material, a plurality of photoconductive granules of substantially the same size in a monogranular layer adhered to the first conductive layer by the binder and with the lateral filler material filling the interstitial space between the granules and leaving that portion of the surface of the granules furthest from the opaque first conductive layer not covered with the lateral filler, said binder also permanently fixing the physical positions of the granules, a second substrate transparent to said radiation, an electrically conductive opaque second layer adhered to said second substrate, said second conductive layer having a plurality of holes substantially smaller in diameter than the granules, the total area of said holes being a substantial fraction of the second layer surface, said second conductive layer being in contact with said granules, said opaque second layer being adjacent the uncovered surface of the photoconductive granules.

13. The product of claim 12 wherein said second opaque conductive layer is a layer of zinc.

14. The product of claim 13 wherein said second substrate is a transparent plastic film.

15. An image recording medium responsive to incident radiation comprising:

a first substrate transparent to said radiation, a radiation transparent electrically conductive first layer on said first substrate, a dielectric binder, an electrically insulating, erosion resistant lateral filler material, a plurality of photoconductive granules of substantially the same size in a single mono-granular layer adhered to the conductive layer by the binder and with the lateral filler material filling the interstitial space between the granules and leaving that portion of the surface of the granules furthest from the transparent first conductive layer not covered with the lateral filler, said binder also permanently fixing the physical positions of the granules, a second transparent substrate, a thin opaque electrically conductive second layer of heat disintegrable metallic material on said second substrate, said opaque layer being between said second substrate and said granules, said structure being capable of electrical conduction between the electrically conductive layers through the dielectric binder.

16. The image recording medium of claim 15 wherein said binder comprises:

a base binder adhering said granules to the transparent conductive first layer, a top binder covering the granules and the base binder.

17. The image recording medium of claim 16 wherein:

said base binder is a thick layer constituting the base buffer, said top binder is a thick layer constituting the top buffer.

18. An image recording medium responsive to incident radiation comprising:

a first transparent substrate, a first thin opaque electrically conductive heat disintegrable metallic layer on said substrate, a dielectric binder, an electrically insulating, erosion resistant lateral filler material, a plurality of photoconductive granules of substantially the same size in a mono-granular layer adhered to the conductive first layer by the binder and with the lateral filler material filling the interstitial space between the granules and leaving that portion of the surface of the granules furthest from the opaque conductive first layer not covered with the lateral filler, said binder also permanently fixing the physical positions of the granules, a second opaque electrically conductive metallic layer covering the lateral filler and making electrical contact with the granules where the granules emerge from the lateral filler without completely covering the emerged area of the granules, thereby allowing the radiation to enter the granules through this top electrode layer, said structure being capable of electrical conduction between electrically conductive layers.

19. The image recording medium of claim 18 wherein said binder comprises:

a base binder adhering said granules to the first opaque conductive layer, a top binder covering the granules and the base binder.

20. The product of claim 19 wherein the binder is shellac.

21. The product of claim 19 wherein the lateral filler is polyvinyl acetate.

22. The image recording medium of claim 19 wherein:

said base binder is a thick layer constituting the base buffer, said top binder is a thick layer constituting the top buffer.

23. The product of claim 18 wherein the first opaque conductive metallic layer is easily heat disintegrable.

24. The product of claim 23 wherein said first metallic layer is a layer of aluminum preferably a few hundred angstroms in thickness.

25. The recording medium of claim 18 wherein:

the plurality of photoconductive granules are comprised of at least two types of granules, each type being selectively photoconductively responsive in a specific spectral range and also having a color providing enhanced transmission of light in the same spectral range, said types being interspersed randomly over the first substrate.

26. An image recording medium responsive to incident radiation comprising:

a first transparent substrate, a thin opaque electrically conductive metallic first layer of heat disintegrable material on said substrate, a dielectric binder, an electrically insulating, erosion resistant lateral filler material, a plurality of photoconductive granules of substantially the same size in a mono-granular layer adhered to the conductive layer by the binder and with the lateral filler material filling the interstitial space between the granules and leaving that portion of the outermost surface of the granules furthest from the opaque conductive layer not covered with the lateral filler, and said binder also permanently fixing the physical positions of the granules, an electrically conductive radiation transparent second layer on both the granules and lateral filler, the electrically conductive layers being capable of passing electric current from one to the other through the intervening dielectric binder and the granules.

27. A positive transparency radiation recording medium for use in conjunction with a voltage source comprising:

a first transparent substrate, a radiation transparent electrically conductive first layer deposited on said first substrate, a second substrate transparent to said radiation, a thin opaque electrically conductive, metallic second layer of heat disintegrable material deposited on said second substrate, said layers being adapted for connection to said voltage source, a layer of photoconductive material comprising a plurality of photoconductive granules of substantially the same size in a filling binder between the electrically conductive layers, said layer of thickness of at least one granular layer but less than two granular layers, said binder also permanently fixing the physical positions of the granules and filling the interstitial space between the granules, said first conductive layer not being in mechanical contact with the granules of the photoconductive material and being adapted to be in non-ohmic electrical contact through the insulating layer of the granular binder which is between the granules and the first conductive layer through mechanical pressure applied to said conductive layers, said opaque second layer is sufficiently thin so that localized holes are produced in it corresponding in location with the radiation image applied through the transparent layer to the photoconductive material because of the heat produced by the current from an applied voltage in combination with the radiation, whereby the distribution of said holes over the area of the opaque layer provides a transparency which is a replica of the distribution of the radiation upon said transparent layer.

28. The image recording medium of claim 27 wherein said plurality of photoconductive granules are in the form of a mono-granular layer of granules.

29. The image recording medium of claim 27 wherein said plurality of photoconductive granules form a layer of granules having a thickness between one and two granules diameters.

30. A positive transparency radiation image recording medium for use in conjunction with a voltage source comprising, a first transparent substrate, a thin opaque electrically conductive metallic first layer of heat disintegrable material on said substrate, a layer of photoconductive material comprising a plurality of photoconductive granules of substantially the same size contained in a filling binder of thickness at least a one-granular layer but less than a two granular thick layer, said binder also permanently fixing the physical positions of the granules, said layer of photoconductive material being deposited on said opaque layer, a radiation transparent electrically conductive second layer deposited on said layer of photoconductive material, said layer of photoconductive material being between the electrically conductive layers which make electrical contact through the filling binder to the granules of the photoconductive material, said conductive layers being adapted for connection to a voltage source, said opaque first layer is sufficiently thin so that localized holes are produced in it corresponding in location withh the radiation image applied through the transparent layer to the photoconductive material because of the heat produced by the current from a voltage applied to the layers in combination with the radiation, whereby the distribution of said holes over the ares of the opaque layer provides a transparency which is a replica of the distribution of the radiation upon said transparent layer.

31. The image recording medium of claim 30 wherein said plurality of photoconductive granules are in the form of a mono-granular layer of granules, 32. The image recording medium of claim 30 wherein said plurality of photoconductive granules form a layer of granules having a thickness between one and two granule diameters.

* * * * *